United States Patent [19]

Rosenberg et al.

[11] Patent Number: 4,756,255

[45] Date of Patent: Jul. 12, 1988

[54] SUB-CALIBER PROJECTILE

[76] Inventors: Gideon Rosenberg, 20 Hanna Senesh Street, Kiryat Tivon 36 000; Moshe Gottesman, 33 Tabenkin Street, Haifa 32 801, both of Israel

[21] Appl. No.: 89,949

[22] Filed: Aug. 26, 1987

Related U.S. Application Data

[63] Continuation of Ser. No. 865,054, May 20, 1986, abandoned.

[30] Foreign Application Priority Data

Jun. 5, 1985 [IL] Israel ..... 75408

[51] Int. Cl.[4] ..... F42B 13/16

[52] U.S. Cl. ..... 102/521

[58] Field of Search ..... 102/520–523, 102/439, 532

[56] References Cited

U.S. PATENT DOCUMENTS 2,382,152 8/1945 Jakobsson ..... 102/523
4,519,317 5/1985 Rosenberg ..... 102/523
4,542,696 9/1985 Bisping et al. ..... 102/523

FOREIGN PATENT DOCUMENTS 2945291 5/1981 Fed. Rep. of Germany ..... 102/520
2237169 2/1975 France ..... 102/520

*Primary Examiner*—Harold J. Tudor

[57] ABSTRACT

A sub-caliber projectile, having a detachable sabot means which comprises leading and trailing obturating members spaced apart along a longitudinal axis of the projectile and releasably secured thereto. A pressure cell is defined between the obturating members communication means being located in the trailing obturating member for effecting communication between the interior of the barrel and the pressure cell and being so designed that the maximum pressure generated in the pressure cell by the influx of propellant gases from the barrel and through the communication means during the launching of the projectile is substantially less than the maximum pressure generated in the barrel and exerted on the trailing obturating member.

6 Claims, 4 Drawing Sheets

SUB-CALIBER PROJECTILE

Figure 1:
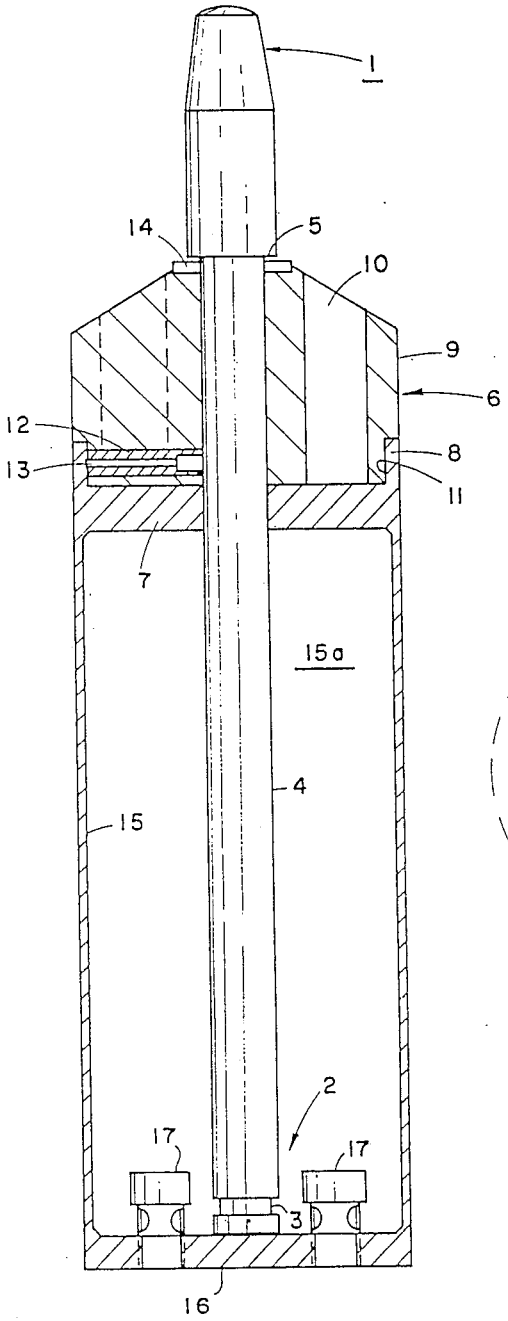

This application is a continuation of application Ser. No. 865,054, filed May 20, 1986, now abandoned.

The present invention relates to a sub-caliber projectile, particularly to the so-called "arrow" or penetrator projectile having a relatively high length to diameter ratio and wherein the central body portion of the projectile is of substantially uniform diameter, the projectile being provided with detachable sabot means which, prior to and during launching is mechanically coupled to the projectile so as, on the one hand centrally to locate the projectile in the larger bored barrel of a launching weapon, and on the other hand, to absorb and transmit to the projectile, the propellant forces generated by the propellant gases in the barrel. Such a projectile will hereinafter be referred to as "a sub-caliber projectile of the kind specified".

With such a sub-caliber projectile of the kind specified, we have previously proposed (U.S. Pat. No. 4,519,317, hereinafter "our prior specification") to form the sabot means so as to comprise both an obturating member and an annular stabilizing member, the sabot means being mounted on and displaceable along the central body portion between a first position wherein it abuts a region of the projectile adjacent a front end thereof and a second position, adjacent a tail end of the projectile wherein the stabilizing member is retained adjacent the tail end whilst the obturating disc member is released from the stabilizing member. Such an arrangement will hereinafter be referred to as "an axially displaceable sabot means of the kind specified".

Alternatively and with a sub-caliber projectile of the kind specified, it has been previously proposed (for example in U.S. Pat. No. 4,187,783) to form the sabot means of a plurality of saddle-shaped sabot segments which, together form a rear obturating member and a front guide member, said members being rigidly coupled together by an integrally formed tubular coupling member, the sabot being coupled to the central body portion of the projectile by a system of intermeshing buttress grooves. Such an arrangement will hereinafter be referred to as "a segmented sabot means of the kind specified".

With known sub-caliber projectiles of the kind specified whether provided with the axially displaceable sabot means of the kind specified or with the segmented sabot means of the kind specified the sabot obturating member has to take up and transmit to the projectile the entire propellant forces generated in the barrel by the propellant gases and this, of necessity requires the provision of an obturating member of relatively substantial bulk and weight. This, of necessity increases the weight of the sabot means with consequent limitations on the velocity of the projectile.

In the case of the sub-cailber projectile having an axially displaceable sabot means of the kind specified the entire propellant forces taken up by the obturating disc member are transmitted therefrom to the projectile in the region thereof adjacent the front end thereby creating in this region considerable tension forces. Where the projectile body is formed of a material such as steel having a relatively high specific strength even a relatively long projectile can effectively withstand such substantial tension forces. Where however the projectile body is formed of material of lower specific strength such as for example tungsten, it has been found that the projectile body is not capable of withstanding such substantial tension forces when its length exceeds a predetermined maximum and in consequence the use of such axially displaceable sabot means with projectiles of materials of relatively low specific strength has of necessity limited the overall length of projectile which can be employed.

It is therefore an object of the present invention to provide a sub-caliber projectile of the kind specified wherein the above referred to disadvantages or limitations are substantially reduced.

According to the present invention there is provided a sub-caliber projectile of the kind specified wherein the sabot means comprises leading and trailing obturating members spaced apart along a longitudinal axis of the projectile and releasably secured thereto; a pressure cell defined between the obturating members; communication means located in the trailing obturating member for effecting communication between the interior of the barrel and the pressure cell and being so designed that the maximum pressure generated in said pressure cell by the influx of propellant gasses from the barrel and through the communication means during the launching of the projectile is substantially less than the maximum pressure generated in the barrel and exerted on said trailing obturating member.

By virtue of the nature and/or dimensioning of the communication means the propulsion pressure exerted on the leading obturating member is, during launching, substantially less than that exerted on the trailing obturating member and in this way the forces transmitted to the projectile from the sabot are distributed along the length of the projectile. When, for example the communication means is constituted by valve means designed to close when subjected to an acceleration exceeding a predetermined value, then in the initial acceleration stages the propellant gases pass through the valve means into the pressure cell so that the propellant forces act on the leading obturating member. When however the acceleration has exceeded the predetermined value the valve means close and a resultant propellant force acts on the trailing obturating member. By virtue of this division, in time and in region of application of the propellant forces applied to the sabot the bulk and weight of the obturating members can be significantly reduced as compared with known sabot means thereby leading to a distinct increase in the overall velocity of the projectile. At the same time and in the case of the axially displaceable sabot means the magnitude of the tension forces applied to the projectile body during acceleration is limited and, during the high acceleration stage the propulsion forces as applied to the projectile generate a linear distribution of stress there along starting with tension (pull) at its leading end and ending by cmpression (push) at its rear end, and in this way it is possible to employ projectile materials of relatively low specific strength such as for example tungsten.

In accordance with one preferred embodiment of the present invention the pressure cell is defined by the obturating members and a cell sidewall, the latter preferably constituting a means for coupling the obturating members together.

In an alternative embodiment the pressure cell is defined by the obturating members and wall of the barrel. In this case the obturating members can either be individually coupled to the projectile body, e.g. by buttress groove coupling, or alternatively a tubular element can be employed which surrounds at least the central body portion of the projectile and which is formed integrally at its ends with the obturating members.

Where the invention is applied to a projectile having axially displaceable sabot means of the kind specified the leading obturating member constitutes the axially displaceable annular obturating disc. Preferably, in this case the trailing obturating member is adapted to bear on the rear end of the projectile.

Where, on the other hand the invention is applied to a projectile having segmented sabot means of the kind specified the front guide member is effectively replaced by the leading obturating member whilst the rear obturating member is constituted by the trailing obturating member, segmented tubular elements being formed integrally, at their ends with the correspondingly segmented leading and trailing obturating members, the tubular elements surrounding the central body portion and meshing therewith by appropriately formed buttress grooves.

Preferably, where as indicated above the communication means is a valve means, the latter can be of the inertial type and is formed with a communicating aperture, aperture closure means and shearable retaining means for retaining the closure means in a first position wherein the aperture is open, the arrangement being such that when the valve means is subjected to acceleration exceeding the predetermined value the retaining means are sheared and the closure means is displaced into a second position wherein the aperture is closed.

Alternatively the communication means can be constituted by throttling nozzles by means of which it can be ensured that the pressure build up in the pressure cell always lags behind that in the barrel at the rear of the trailing obturating member and that, in this way the maximum propulsion pressure effective on the leading obturating member during launching is always substantially less than that effective on the trailing obturating member.

Where the projectile is of a particularly high length to diameter ratio it may be found desirable that a plurality of trailing obturating members be employed which are respectively spaced apart along the lenth of the projectile body, each pair of obturating members defining between them a pressure cell whilst all the trailing obturating members being provided with communication means.

Figure 2:
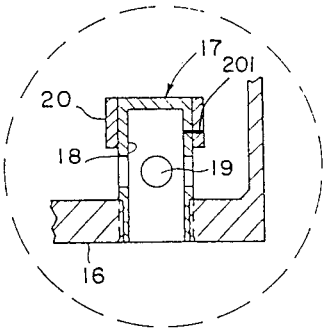
Figure 3:
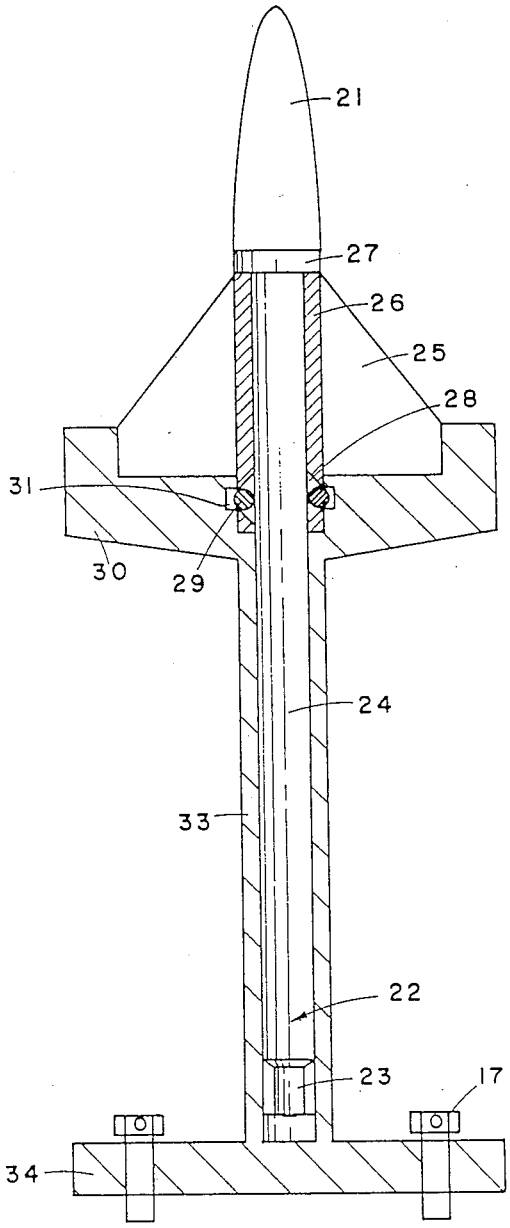
Figure 4:
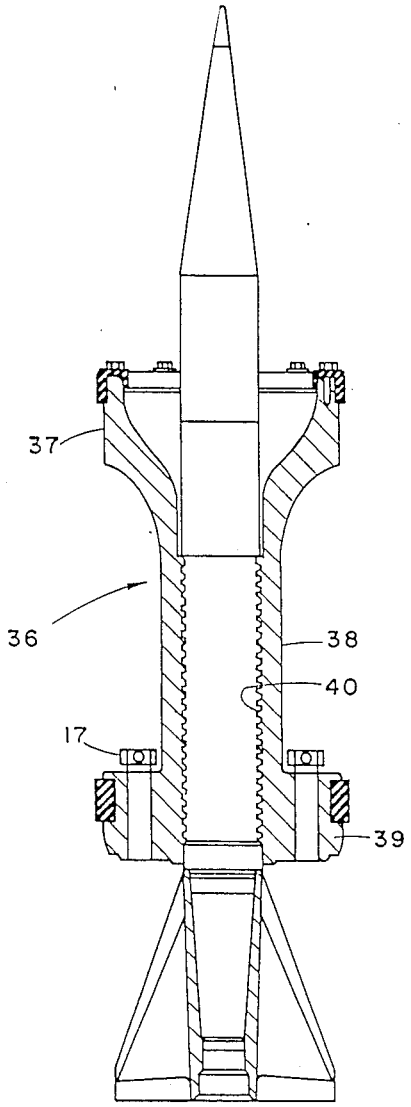
Figure 5:
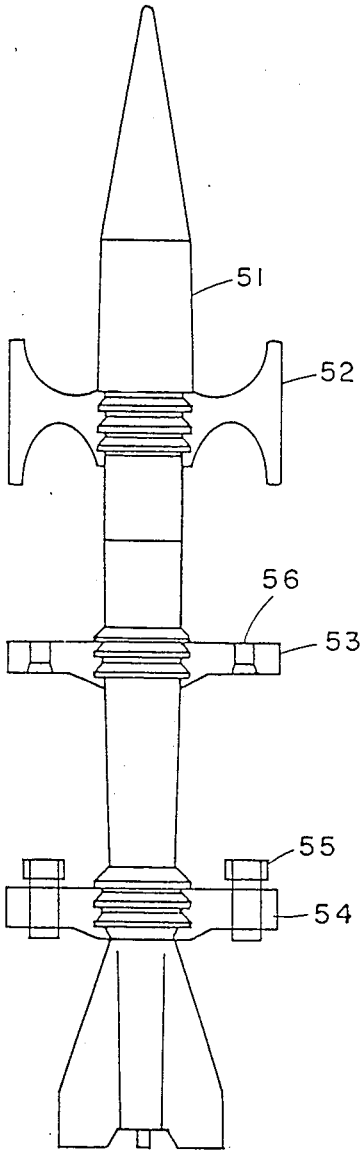

For a better understanding of the present invention and to show how the same may be carried out in practice reference will now be made to the accompanying drawings in which FIG. 1 is a side elevation of a sub-caliber projectile of the kind specified and in accordance with the present invention having an axially displaceable sabot means of the kind specified with the latter being shown in section, FIG. 2 is a view, on an enlarged scale of a detail shown in FIG. 1, FIG. 3 is a longitudinally sectioned view of a modified form of sub-caliber projectile of the kind specified in accordance with the invention having an axially displaceable sabot means of the kind specified, FIG. 4 is a longitudinally sectioned view of a further embodiment of sub-caliber projectile of the kind specified and in accordance with the present invention having segmented sabot means of the kind specified, and FIG. 5 is a schematic side elevation of a modified form of sub-caliber projectile of the kind specified and in accordance with the invention.

Referring to FIG. 1 of the drawings there is here shown a sub-caliber projectile of the kind specified having axially displaceable sabot means of the kind specified and as described and illustrated in our prior specification whose contents and disclosure are hereby incorporated by way of reference.

The projectile is formed with an ogival front end 1, a tail end 2 formed with an annular peripheral recess 3 and a cylindrically shaped mid-section 4 of substantially uniform diameter. The latter merges with the ogival front end 1 via an annular, abutment shoulder 25.

The projectile is provided with sabot means 6, comprising a leading annular obturating disc member 7 having a peripheral skirt 8 and a substantially cylindrical stabilizing member 9. The latter is formed with a plurality of throughgoing, axially directed, bores 10 and with a peripheral recess 11 into which is designed to fit the skirt 8. There is furthermore formed in the member 9 a radially directed bore 12 in which is located a spring loaded retaining pin 13.

The forward end of the stabilizing member 9 is tapered and is provided as its central planar end portion with a bearing disc 14.

The sabot means 6 is clearly slidable along the mid-section 4 from a first position, wherein the bearing disc 14 bears against the abutment shoulder 5 to a second position wherein the innermost end of the spring loaded pin 13 enters the recess 3 so as to retain the stabilising member 9 on the tail end 2 and to allow for the detachment of the obturating disc 7.

As described up to now the sub-caliber projectile and its axially displaceable sabot means is constructed and operates as illustrated and described in our previous specification.

Formed integrally with the leading obturating member 7 is a cylindrical side wall 15 which surrounds the cylindrically shaped mid-section 4 of the projectile body and which terminates in an endwall constituting a trailing obturating member 16. The obturating members 7 and 16 and the side wall 15 together define a pressure cell 15a. The obturating member 16 is juxtaposed with respect to the tail end 2 of the projectile and which is provided with a pair of communication means constituted by valves 17.

As clearly seen in FIG. 2 of the drawings each valve 17 comprises a tube 18 formed with a set of peripheral apertures 19 and sealed at its upper end. The upper end of the tube is surrounded by a closure ring 20 which is coupled to the upper end of the tube 18 by shearable means such as a well-known shear pin 201.

The valves 17, which are of the inertial type, are designed to operate such that when they are subjected to an acceleration exceeding a predetermined maximum the shearable means are sheared and the closure rings 21 move downwardly on the tube so as to close the apertures 19.

In use, with the projectile located in the barrel of a launching weapon (not shown), the trailing obturating member 16 effectively seals the bore of the barrel. Upon firing however propulsion gases pass through the open valves 17 so as to fill the pressure cell **15*a* and so as to bear on the leading obturating member 7**. The latter takes up the propulsion forces and, as a consequence the projectile is launched.

Thus, in the initial stages of launching and before the acceleration of the projectile has reached a predetermined value substantially all or at least the bulk of the propellant forces are exerted on the leading obturating member 7. When however the acceleration of the projectile passes beyond the predetermined value the valves 17 close and a resultant propulsion force is exerted on the trailing obturating member 16 which is transmitted to the projectile via its tail end 2. It will be realized that this propulsion force exerted on the projectile is in fact a compressive force (push) as compared to the tension force (pull) exerted on the projectile via the disc 14 and abutment shoulder 5 by the propulsion gases acting on the leading obturating member 7.

In this way the propellant forces act on axially separated apart regions of the projectile, the tension forces applied to the projectile being applied when the acceleration is below the predetermined value and the compression forces being applied when the acceleration forces exceed the predetermined value. Thus, the possibly deleterious effects of applying unduly high tension forces to a projectile formed of a material of relatively low specific strength (tungsten) are substantially reduced.

Furthermore by virtue of the fact that there is this effective division of the forces acting on the sabot the constituent operating members of the sabot can be made of relatively low weight thereby considerably lowering the weight of the sabot as a whole and increasing the overall velocity of the projectile.

It will be appreciated that the subsequent axial displacement of the sabot, the retention in position of the stabilizing member and the discarding of the obturating members all take place in a manner as described in our prior specification.

In the modified embodiment shown in FIG. 3 of the drawings a sub-caliber projectile of the kind specified is again formed with an ogival front end 21, a tail end 22 formed with an annular peripheral recess 23 and a cylindrically shaped mid-section 24 of substantially uniform diameter.

Stabilizing fins 25 of a diameter less than that of the barrel extend radially from a cylindrical hub 26 which is slidable on the mid-section 24 from a first position adjacent an abutment ring 27 to a second position adjacent the tail end 22.

Formed in a downstream end of the hub 26 are tapering holes 28 in each of which is located a retaining ball 29.

Bearing against the downstream end of the stabilizing fins 25 and fitting therein is a leading obturating member 30 whose upper end surrounds the lower end of the hub 26 and is formed with a peripheral groove 31 into which projects the outer portions of retaining balls 28.

Surrounding the cylindrical mid-section 24 is a tubular coupling member 33 the lower end of which is formed integrally with a trailing obturating member 34 provided with valves 17.

As can be seen from the drawings the stabilizing fins 25 are coupled to the leading obturating member 30 by means of the retaining balls 32 which project into the peripheral grooves 31.

Upon completion of the launching of the projectile, the sabot means is displaced rearwardly under the influence of the aerodynamic forces acting thereon and in its rearmost position the balls 28 enter the recess 23 into which they are pushed thus freeing the obturating members 30 and 34 from the stabilizing fins 25. The obturating members 30 and 34 are therefore detached whilst the stabilizing fins 25 on the other hand are retained by the balls 28 to the rear end of the projectile.

With the projectile and its sabot means located in the barrel of a launching weapon, the leading and trailing obturating members 30 and 34 define, together with the walls of the barrel, a pressure cell and upon launching the propellant gases enter the pressure cell through the valves 17 so as to bear on the leading obturating member 30 and thereby to transmit to the projectile the tension forces (the pull) which initiate the launching of the projectile. When however the acceleration has reached a level beyond the predetermined value the valves 17 close and a resultant propellant forces acts on the trailing obturating member 34 so as to exert a compressive (push) force on the projectile.

Thus, as before, the propellant forces are distributed along the length of the projectile and are also distributed in time so that only during the initial stages of launching is a tension force applied to the leading end of the projectile whilst subsequently, when the acceleration has exceeded the predetermined value, the propulsion is effected by the exertion of a compression force adjacent the rear end of the projectile. Here too this arrangement facilitates the use of materials having a relatively low specific strength and with obturating members of relatively low weight.

FIG. 4 shows the application of the invention to a sub-caliber projectile of the kind specified having the segmented sabot means. This type of sabot means, its construction and operation is clearly described in prior U.S. Pat. No. 4,187,783 whose disclosure is hereby incorporated by way of reference and to which reference can be made for a detailed description.

For the purposes of understanding the application of the present invention it will suffice to note that a segmented sabot means 36 comprises a segmented leading obturating member 37 (corresponding to the segmented guide member described in prior U.S. Pat. No. 4,187,783) coupled by a segmented tubular coupling neck 38 to a segmented trailing obturating member 39 formed with valves 17. The sabot means 36 is coupled to the central cylindrical section of the projectile by a buttress groove arrangement 40 as clearly described and illustrated in the prior patent specification.

In use, the leading and trailing obturating members 37 and 39 define, together with the walls of the barrel, a pressure cell and this pressure cell is filled with propellant gases which pass into the cell via the valves 17 during the initial launching stages when the acceleration of the projectile is still below the predetermined value. In this case the propellant forces act on the leading obturating member 37 which transmits these forces to the projectile via the buttress groove 40. When however the acceleration of the projectile exceeds the predetermined value of resultant propellant force acts on the trailing obturating member 39.

The application of the present invention to this segmented sabot 36 gives rise to the following distinct advantages:

(a) By converting the front guide portion of the segmented sabot into an effective leading obturating member 37 it is possible substantially to reduce the overall dimensions and weight of the trailing obturating member 39 and the coupling neck 38 and this, as previously indicated, has distinctly beneficial effects on the overall velocity of the projectile;

(b) In view of the fact that the elastic modulus of the materials constituting the sabot 36 and, in particular, the coupling neck 38 thereof substantially increases as a result of the generation and application of hydrostatic pressure in the pressure cell the strength of the sabot in these regions is substantially increased and this without necessity of increasing the amount of materials and weight;

(c) By the exertion of the hydrostatic pressure on the coupling neck 38 the effective seal of the coupling neck against the projectile body is increased thereby substantially minimizing the danger of leakage of propulsion gases therethrough, and (d) The application of hydrostatic pressures to the coupling neck 38 considerably improves the even distribution and application of the propulsion stresses by the sabot to the projectile.

In the embodiment shown in FIG. 5 of the drawings a sub-caliber projectile 51 of a relatively high length to diameter ratio is shown which is provided, in addition to a leading obturating member 52 with a succession of trailing obturating members 53 and 54 which are respectively spaced apart along the length of the projectile 51, each pair of members 51, 53 and 53, 54 defining, with the barrel walls (not shown) a pressure cell. Each member is secured to the projectile body by means of a buttress groove arrangement.

Whilst the rearmost obturating member 54 is provided with inertial valve means 55 of the kind described above, the intermediate obturating member 53 is provided with communication means in the form of throttling nozzles 56. These nozzles are so dimensioned that the build up of propellant gas pressure in the pressure cell upstream of the nozzle 56 always lags behind the build up downstream of the nozzle 56 and in this way the propellant pressure exerted on the obturating member 52 is always significantly less than that exerted on the member 53.

It will be realized that whilst the use of throttling nozzles as communication means has been illustrated and described with reference to a multiple, trailing, obturating member construction as shown in FIG. 5 of the drawings, it is equally applicable to a single trailing obturating member construction as shown, e.g. in FIGS. 1–4 of the drawings.

I claim:

1. In a combination of a sub-caliber projectile having a central body portion of substantially uniform diameter, and detachable sabot means which, prior to and during launching is mechanically coupled to the projectile so as centrally to locate the projectile in a larger bored barrel of a launching weapon, and to absorb and transmit to the projectile, the propellant forces generated by the propellant gases in the barrel, the improvement wherein said sabot means comprises a leading imperforate obturating member serving to seal said barrel against passage of propulsion gases; a trailing, partially perforate, obturating member spaced from said leading obturating member along a longitudinal axis of the projectile, said obturating members being releasably secured to the projectile and together constituting a propulsion force distributing means for transmitting a first pulling force to a forward end of the projectile and a second pushing force to a trailing end of the projectile; a pressure cell defined between said obturating members; valve means located in said trailing obturating member for effecting restricted communication between the interior of the barrel and said pressure cell, each valve means being formed with a communicating aperture, aperture closure means and shearable retaining means for retaining said closure means in a first position where said aperture is open, the arrangement being such that when said valve means is subjected to acceleration exceeding a predetermined value said retaining means is sheared and said closure means is displaced into a second position wherein said aperture is closed and that upon launching, propulsion gases pass into said cell via said valve means so as to bear on said leading obturating member with the maximum pressure generated in said pressure cell by the influx of propellant gases from the barrel during the launching of the projectile being substantially less than the maximum pressure generated in the barrel and exerted on said trailing obturating member, but when the acceleration of the projectile exceeds said value, said valve means closes and resultant propulsion forces bear on said trailing obturating member.

2. The improvement according to claim 1 wherein said pressure cell is defined by said obturating members and a cell side wall.

3. The improvement according to claim 2 wherein said cell side wall constitutes a sabot coupling means serving to couple together said obturating members.

4. The improvement according to claim 1 wherein the sabot means furthermore comprises an annular stabilizing member initially coupled to said leading obturating member, the sabot means being mounted on the central body portion with said leading obturating member displaceable between a first position wherein it abuts a region of the projectile adjacent a front end thereof and a second position, adjacent a tail end of the projectile wherein the stabilizing member is retained adjacent the tail end whilst the leading obturating member is released from the stabilizing member and together with the trailing obturating member become detached from the projectile at the rear thereof.

5. The improvement according to claim 4 wherein said trailing obturating member is adapted to bear on a rear end of said projectile.

6. In a combination of a sub-caliber projectile having a central body portion of substantially uniform diameter, and detachable sabot means which, prior to and during launching is mechanically coupled to the projectile so as centrally to locate the projectile in a larger bored barrel of a launching weapon, and to absorb and transmit to the projectile, the propellant forces generated by the propellant gases in the barrel, the improvement wherein said sabot means comprises leading and trailing obturating members spaced apart along a longitudinal axis of the projectile and releasably secured thereto; a pressure cell defined between said obturating members; communication means located in said trailing obturating member for effecting restricted communication between the interior of the barrel and said pressure cell and so that the maximum pressure generated in said pressure cell by the influx of propellant gases from the barrel and through the communication means during the launching of the projectile is substantially less than the maximum pressure generated in the barrel and exerted on said trailing obturating member; wherein the sabot means furthermore comprises an annular stabilizing member initially coupled to said leading obturating member, the sabot means being mounted on the central body portion with said leading obturating member displaceable between a first position wherein it abuts a region of the projectile adjacent a front end thereof and a second position, adjacent a tail end of the projectile wherein the stabilizing member is retained adjacent the tail end whilst the leading obturating member is released from the stabilizing member and together with the trailing obturating member become detached from the projectile at the rear thereof; wherein said communication means is constituted by one or more valve means, each valve means being formed with a communicating aperture, aperture closure means and shearable retaining means for retaining said closure means in a first position where said aperture is open, the arrangement being such that when said valve means is subjected to acceleration exceeding a predetermined value said retaining means is sheared and said closure means is displaced into a second position wherein said aperture is closed; the arrangement being such that upon launching, propulsion gases pass into said cell via said valve means so as to bear on said leading obturating member but when the acceleration of the projectile exceeds said value, said valve means closes and resultant propulsion forces bear on said trailing obturating member.

* * * * *

UNITED STATES PATENT AND TRADEMARK OFFICE

CERTIFICATE OF CORRECTION

PATENT NO. : 4,756,255

DATED : July 12, 1988

INVENTOR(S) : ROSENBERG et al

It is certified that error appears in the above-identified patent and that said Letters Patent is hereby corrected as shown below:

Add the following on the first page of the patent:

--[73] Assignee: The State of Israel, Ministry of Defence, Rafael Armament Development Authority, of Hakirya, Tel-Aviv, Israel--

Signed and Sealed this

Second Day of May, 1989

*Attest:*

DONALD J. QUIGG

*Attesting Officer*

*Commissioner of Patents and Trademarks*